United States Patent [19]

Kralowetz

[11] Patent Number: 4,497,195

[45] Date of Patent: Feb. 5, 1985

[54] SWAGING MACHINE

[75] Inventor: Bruno Kralowetz, Steyr, Austria

[73] Assignee: Firma GFM Gesellschaft fur Fertigungstechnik und Maschinenbau Gesellschaft m.b.H., Steyr, Austria

[21] Appl. No.: 440,338

[22] Filed: Nov. 9, 1982

[30] Foreign Application Priority Data

Nov. 16, 1981 [AT] Austria ..... 4921/81

[51] Int. Cl.[3] ..... B21P 41/00

[52] U.S. Cl. ..... 72/402; 72/452

[58] Field of Search ..... 72/402, 452, 76, 406

[56] References Cited

U.S. PATENT DOCUMENTS

| | | | |
|---|---|---|---|
| 3,572,077 | 3/1971 | Kralowetz | 72/402 |
| 3,621,702 | 11/1971 | Kralowetz | 72/452 |
| 3,690,142 | 9/1972 | Blaimschein | 72/402 |
| 3,837,210 | 9/1974 | Kralowetz | 72/452 |
| 3,871,223 | 3/1975 | Kralowetz et al. | 72/402 |
| 3,889,514 | 6/1975 | Kralowetz et al. | 72/402 |

*Primary Examiner*—Daniel C. Crane
*Assistant Examiner*—David B. Jones
*Attorney, Agent, or Firm*—Kurt Kelman

[57] ABSTRACT

A swaging machine comprises eccentric-driven swaging rams provided with a slide track extending transversely to the axis of the eccentric, and a slide block rotatably mounted on the eccentric and guided by said slide track as in a Scotch yoke. To provide a structure which is simple, inexpensive and light in weight, each swaging ram is coupled to the associated slide block at that end face of the swaging ram which is remote from the die. The slide track is formed by a head portion of the swaging ram and interengages with an associated guide rail of the slide block.

3 Claims, 2 Drawing Figures

SWAGING MACHINE

SUMMARY OF THE INVENTION

Figure 1:
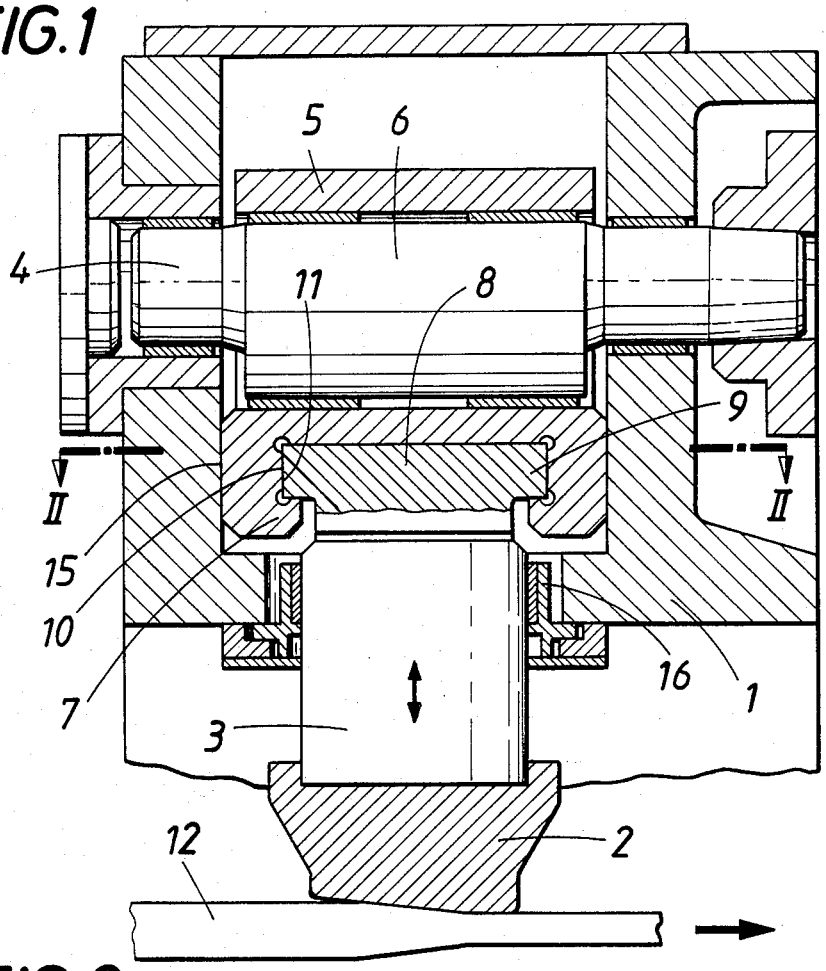

This invention relates to a swaging machine comprising eccentric-driven swaging rams, each of which comprises a slide track that extends transversely to the axis of the associated eccentric, and a slide block which is rotatably mounted on the eccentric and guided by said slide track as in a Scotch yoke.

Such swaging machines serve mainly for swaging continuous or rod-shaped workpieces. Each revolution of the eccentric shaft results in a complete stroke of the reciprocating rams. To ensure a substantially constant speed of travel of the workpiece, a feed movement in the direction of travel may be superposed on said reciprocating motion. In order to provide the Scotch yoke required for driving the swaging rams by eccentrics, the swaging rams have previously been provided with a cam slot provided on both sides with the slide track for the slide block extending into the cam slot. An additional guidance of the swaging ram is ensured by providing the ram on that side of the cam slot which is remote from the workpiece with an extension extending in the longitudinal direction of the swaging ram and into suitable tracks provided in the swaging box. In those known swaging machines, the swaging rams extend radially beyond the eccentric shaft to a large extent and are massive elements provided with the cam slots so that a substantial overall space and structural expenditure are involved. As a result, the swaging machine, particularly if it comprises a plurality of dies, had large dimensions and a heavy weight.

It is an object of the invention to eliminate these disadvantages and to provide a swaging machine which is of the kind described first hereinbefore and is structurally simple and inexpensive and relatively light in weight and has relatively small dimensions.

This object is accomplished according to the invention in that the end of each swaging ram which is remote from the workpiece is coupled to the associated slide block and provided with a head portion which is formed with the slide track, and each slide block is provided with a guide rail which interengages with said slide track. The engagement of each swaging ram at its radially outer end with the associated slide block permits the provision of a structure which saves space and material because the swaging rams do not extend beyond the eccentric shafts and do not embrace the slide block. The interengagement of the slide track and guide rail results in a simple, functionally reliable coupling of the swaging ram and the slide block in the longitudinal direction of the ram and provides the required freedom of movement of the slide block relative to the head portion of the swaging ram in a direction which is transverse to the longitudinal direction of the ram. Suitable sliding surface bearings in the swaging box ensure that the swaging ram will be properly guided. A machine embodying these features has a compact, robust and efficient structure.

If it is desired to impart to the swaging rams, in addition to their longitudinal swaging motion in a radial direction to and from the workpiece, a feed movement in the direction of the longitudinal axis of the workpiece, I provide the slide track formed on the head portion of the swaging ram with surfaces which include acute angles with a plane that is normal to the axis of the associated eccentric and form the guide rail of the slide block with oblique surfaces which are complementary to and engage said oblique surfaces of said slide track. Besides, the slide block is prevented from moving in the direction of the axis of the eccentric and a slide track is provided for guiding the swaging ram in the direction of travel of the workpiece. With this arrangement, the desired feed movement can be imparted to the workpiece without need for a substantial structural expenditure because it is sufficient to provide the slide track of the head portion of the swaging ram and the guide rail of the slide block with oblique surfaces which are adapted to cooperate in the required manner. In such an arrangement the extent of the feed movement per stroke of the swaging ram will depend on the angle of the oblique surfaces. Besides, the feed movement will not consist of an angular motion of the swaging rams, as was previously the case, but of a translational movement of the swaging ram whereas the axis of the latter will remain parallel to itself during the swaging movement and during the feed movement.

According to a desirable structural feature of the invention the head portion of the swaging ram is a parallelogram in cross-section, one pair of mutually opposite sides thereof constitute the slide track which cooperates with the guide rail of the slide block and the other pair of opposite sides constitute slide faces which cooperate with the longitudinal track. In that case the head portion of the swaging ram serves not only to couple the swaging ram to the slide block but also to guide the swaging ram so that the structure is further simplified.

Figure 2:
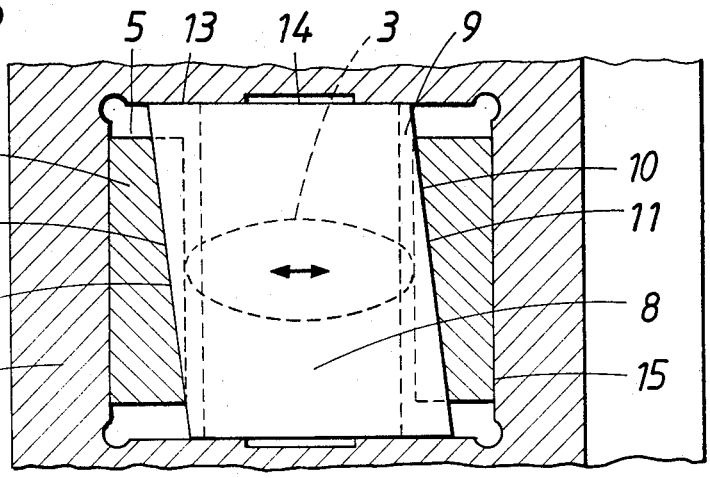

An illustrative embodiment of the invention is strictly diagrammatically shown on the accompanying drawing, in which FIG. 1 is an axial sectional view showing a portion of a swaging machine according to the invention and FIG. 2 is a sectional view taken on line II—II in FIG. 1.

Radially extending swaging rams 3 are mounted in a swaging box 1 and carry swaging dies 2. Each swaging ram 3 is driven by an eccentric 6, which is non-rotatably mounted on shaft 4 which is rotatable on its axis. Each eccentric 6 is rotatably mounted in a slide block 5 provided with a guide rail 7, which extends transversely to the eccentric shaft 4 and receives a head portion 8 of the associated swaging ram 3. The head portion 8 of the swaging ram 3 is formed with a slide track 9 embraced by and interengages with the guide rail 7 of the slide block 5 to couple swaging ram 3 and slide block 5 for common movement in the longitudinal direction of the swaging ram while the guide rail 7 and the head portion 8 of the swaging ram are slidable relative to each other transversely to the longitudinal direction of the swaging ram.

As is apparent from FIG. 2, the slide track 9 of the swaging ram head portion 8 has two parallel oblique surfaces 10, which are complementary to and cooperate with suitable guiding surfaces 11 of the guide rail 7 so that a rotation of the eccentric shaft 4 will result not only in a reciprocating longitudinal swaging motion of the swaging ram 3 but also in a feed motion extending parallel to the axis of the workpiece 12 and superposed on said swaging motion. This is due to the fact that the rotation of the eccentric 6 does not result only in a reciprocating swaging motion of the slide block 5 toward and away from the workpiece 12 but also in a reciprocating motion which is transverse to said swaging motion so that a second motion is imparted also to the swaging ram 3 owing to the cooperation of the oblique surfaces 10 of the head portion 8 of the swaging ram 3 and the complementary oblique surfaces 11 of the guide rail 7. The direction of that second motion is determined by the longitudinal slide track 13 formed by the swaging box 1 and by the slide surface 14 on said head portion 8 of the swaging ram, which cooperates with said longitudinal slide track. To ensure that the head portion 8 of the swaging ram 3 will be transversely displaced rather than the slide block 5, the outside surface 15 of the guide rail 7 is held in swaging box 1 against movement in the axial direction of the eccentric shaft 4. The swaging ram 3 is guided by a sliding surface bearing 16, which is movable along the longitudinal track 13 and permits a guidance of the swaging ram 3 in its longitudinal direction and in the feeding direction. As a result, the rotation of the eccentric shaft 4 imparts to the swaging ram 7 a longitudinal swaging motion and also a feed movement in the feed direction so that the workpiece will travel at a substantially constant speed as it is swaged.

Owing to the direct coupling of the swaging ram 3 to the slide block 5 and the cooperation of the specially designed head portion 8 of the swaging ram 3 with the guide rail 7 of the slide block 5, the swaging machine is simple and reliable in function and has a structure which is space-saving and light in weight.

What is claimed is:

1. In a swaging machine comprising a frame, a plurality of generally radially extending, angularly spaced and longitudinally reciprocable swaging rams a respective one of said rams being mounted in a respective slide track of said frame, each swaging ram having radially inner and outer ends, a plurality of ram-operating mechanisms for longitudinally reciprocating respective ones of said rams, each of said ram-operating mechanisms comprising a slide block arranged to be guided by said slide track of the respective ram and an eccentric mounted in said slide block for rotation on an axis of rotation which is transverse to the longitudinal direction of said ram, said slide track extending transversely to said axis of rotation, the improvement residing in that each of said blocks comprises a guide rail extending transversely to said axis of rotation and to the longitudinal direction of the respective ram, and each of said rams comprises at its radially outer end a head portion extending into said guide rail and coupled thereto for common movement in the longitudinal direction of said ram along said slide track, the head portion being in slidable engagement with, and slidable along, said guide rail and said head portion of each of said rams has in cross-section the configuration of a parallelogram having two pairs of mutually opposite sides, one of said pairs of opposite sides constitutes said oblique surfaces, and the other of said pairs of opposite sides constitutes slide faces in slidable engagement with one of said slide tracks adapted to guide the head portion along said path.

2. The improvement set forth in claim 1 in a swaging machine which defines a path for a workpiece to be swaged and in which said rams extend generally radially with respect to said path and each of said ram-operating mechanisms is operable to longitudinally reciprocate the respective ram and to impart to the respective ram a transverse feed movement for feeding a workpiece along said path, wherein said head portion has oblique surfaces extending at an acute angle to a plane that is normal to said axis of rotation, said guide rail has oblique surfaces which are complementary to, and in slidable engagement with, said oblique surfaces of said head portion, means are provided for holding said slide block against movement along said axis of rotation and said machine frame defines slide tracks engaged by respective ones of said head portions and adapted to guide them along said path.

3. The improvement set forth in claim 1 as applied to a swaging machine in which each of said eccentrics is mounted in the associated slide block for rotation on a stationary axis of rotation.

* * * * *